US005706737A

United States Patent [19]

Whitehead et al.

[11] Patent Number: 5,706,737

[45] Date of Patent: Jan. 13, 1998

[54] MULTI-PURPOSE SPORT SHELF

[75] Inventors: Stephen P. Whitehead, Elgin; Torrence Anderson; Michael G. Uffner, both of Naperville, all of Ill.

[73] Assignee: Suncast Corporation, Batavia, Ill.

[21] Appl. No.: 634,815

[22] Filed: Apr. 19, 1996

[51] Int. Cl.[6] ..... A47B 23/00

[52] U.S. Cl. ..... 108/42; 108/152; 211/18

[58] Field of Search ..... 108/42, 108, 152, 108/47; 211/5, 17, 18, 19, 20, 22

[56] References Cited

U.S. PATENT DOCUMENTS

| | | | |
|---|---|---|---|
| 2,633,998 | 4/1953 | Derman | 108/152 X |
| 3,220,363 | 11/1965 | Gingher | 108/108 X |
| 3,565,020 | 2/1971 | Schier | 108/152 |
| 4,633,789 | 1/1987 | Kotering et al. | 108/152 |
| 4,936,467 | 6/1990 | Bobeczko . | |
| 5,188,246 | 2/1993 | Maxworthy | 108/152 X |
| 5,203,462 | 4/1993 | Brooks . | |
| 5,253,837 | 10/1993 | Loux | 108/152 X |
| 5,325,973 | 7/1994 | Reedy | 211/18 |
| 5,413,228 | 5/1995 | Le Clerc . | |

FOREIGN PATENT DOCUMENTS

| | | | |
|---|---|---|---|
| 2156199 | 10/1985 | United Kingdom | 108/152 |
| 5693 | 5/1991 | WIPO | 211/5 |

*Primary Examiner*—Jose V. Chen
*Attorney, Agent, or Firm*—Thomas W. Tolpin

[57] ABSTRACT

A multi-purpose storage apparatus having interchangeable shelving for use in storage of sporting goods is disclosed. Shelf construction consists of rod members or alternatively, shelf construction may consist of a single plastic piece having steel tubes integrated into the shelf. In this manner, the consumer may construct a shelf configuration for a particular sporting item. Structural rigidity is provided through the rod members having steel tubing that is encapsulated in a plastic sleeve through a manufacturing process while the plastic shelf has the steel tube directly integrated. The storage apparatus is secured to a wall and includes provisions for support of a bicycle, as well as miscellaneous small items through the use of a support tray.

13 Claims, 3 Drawing Sheets

MULTI-PURPOSE SPORT SHELF

FIELD OF THE INVENTION

This invention relates to storage devices and more particularly to a multi-purpose storage shelf utilizing interchangeable shelves for consumer preference storage of sporting goods.

BACKGROUND OF THE INVENTION

Storage of sporting goods presents a special problem to the average consumer. The problem is the multitude of shapes that sporting goods entail. For instance, ball shaped items such as basketballs, volleyballs, baseballs, tennis balls, and so forth must all be stored in a manner to prevent them from rolling away. However, the average consumer typically owns more than a single sized ball making a storage apparatus that is specifically designed to accommodate a single sized sporting item inappropriate.

Storage of ball shaped sporting items on a flat shelf presents apparent problems, the most obvious of which is the need to prevent the ball shaped items from rolling off the shelf. For this reason, there exists sports racks designed to prevent ball shaped items from rolling. A sports rack typically consists of a shelf formed from two rod members used to maintain the ball shaped sporting good from rolling. A sports rack capable of holding basketballs may not be able to support smaller items such as a baseball. An adjustable sports rack may assist in providing a range of storage sizes but does not alleviate the problem. Sports racks are also known to incorporate the wall for support which allows a broader range of storage items but results in the soiling of the support wall.

Still another problem with storage devices is their material of construction. A shelving system made entirely of plastic may not provide the desired rigidity resulting in sagging. A shelf made of a thick plastic is costly to manufacture and of questionable aesthetic appearance. A shelf made of steel provides strength but is heavy. Reducing the mass of steel to the thickness of sheet metal reduces the weight but has a direct effect on rigidity. In addition, a metal shelf can be easily marred by the improper placement of an item such as metal cleated baseball shoes. Should the paint be marred so as to expose the metal surface, it will lead to unsightly rust.

Thus, what is lacking in the art is an affordable shelving system that has the strength of steel yet the corrosion resistance of plastic that may operate as a sporting rack or shelf allowing a consumer to choose the type of storage system most appropriate to their sporting activity.

SUMMARY OF THE INVENTION

The instant invention is a multi-purpose storage apparatus capable of holding a variety of sports paraphernalia in an orderly manner. The invention employs plastic side wall support members having attachment areas allowing for the support of rod members or a planar support shelf therebetween. The rod members are constructed of a steel tube having a polyethylene sleeve bound to the tubing during a unique manufacturing process. The side wall members can accommodate up to six adjoining rod members or any variation therebetween allowing a consumer to choose the amount of supporting shelf a particular sporting item warrants. A tray is also provided for support of miscellaneous items.

Alternatively, an upper support shelf may consist of a flat plastic shelf having integrated steel rod members. During construction of this flat plastic shelf, a steel tube is placed in each side edge of the shelf. Once the plastic has cooled the steel tubes are permanently encompassed within the plastic shelf providing rigidity while maintaining the non-corrosive properties of plastic.

Thus, an objective of the instant invention is to disclose a multi-purpose sports rack that allows a consumer to choose the amount of support members necessary to accommodate a particular shelving requirement.

Another objective of the instant invention is to disclose a storage apparatus that employs a commonality of components allowing for a reduction in production costs.

Still another objective of the instant invention is to disclose a combination steel and plastic shelf which provides the strength and rigidity of steel, yet the lightweight, non-corrosive characteristics of plastic.

Yet still another objective of the instant invention is to disclose the use of polyethylene encompassed tube members to provide lightweight rod members spanning support members.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
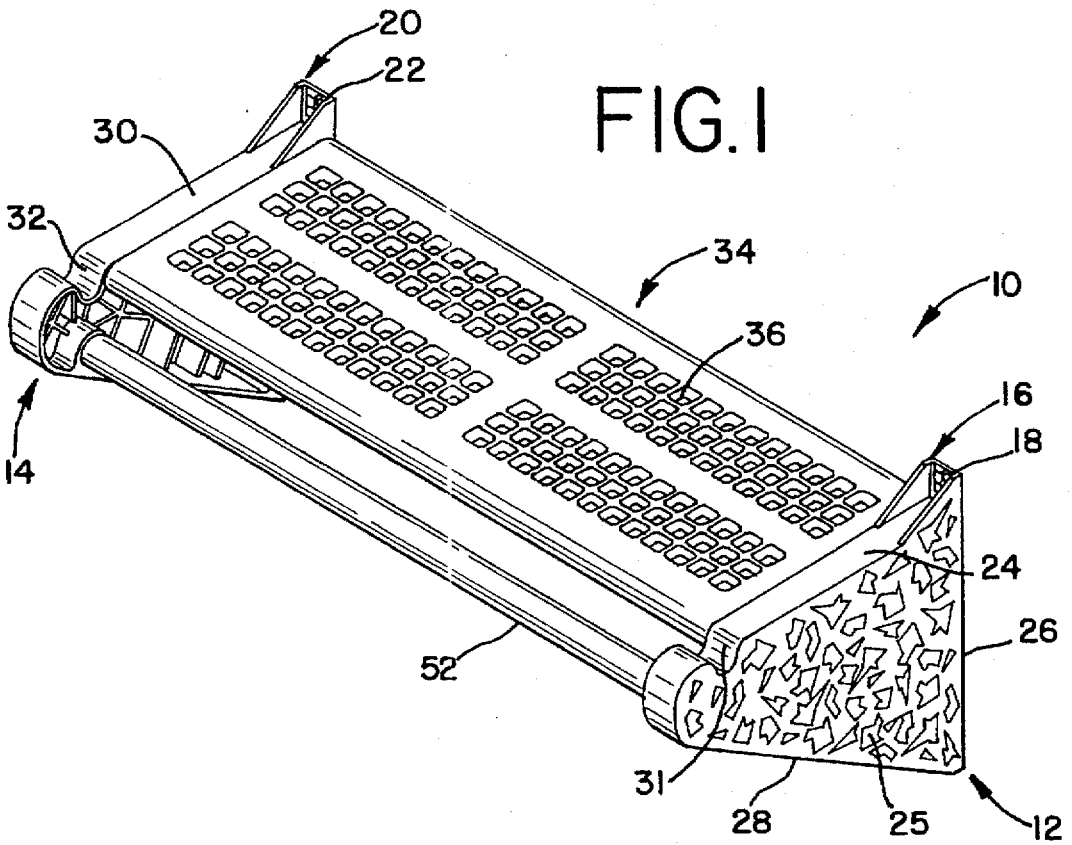
FIG. 1 is a perspective view of the storage shelf with a flat shelf installed.

It is to be understood that while we have set forth certain forms of the invention in a way of illustration, it is not to be limited to the specific form or arrangement of parts herein described and shown. It will be readily apparent to those skilled in the art that various changes may be made without departing from the scope of the invention and the invention is not to be considered limited to what is shown in the drawings and described in the specification.

Referring to the various figures and in particular FIG. 1, set forth is a first embodiment of the storage apparatus of the instant invention depicted by numeral 10 which provides multi-purpose storage shelf and sport shelf. The storage apparatus includes a first side wall 12 and a second side wall 14 which provide frame support members and are of identical configuration forming mirror images of each other. Side wall 12 includes a raised support tab 16 having through hole 18 for use in securing the side wall to a wall by use of a fastener. Similarly side wall 14 includes a raised support tab 20 having through hole 22 for use in securing the side wall to a wall by use of a fastener. For ease of attachment, through holes 18 and 22 are keyhole shaped allowing the side walls to be hooked over an embedded fastener. The outer surface 25 of each side wall includes indicia molded thereon providing an ornamental design.

Side wall 12 has a back edge 26 for securement to a vertical wall, not shown, an upper edge 24 positioned along a horizontal plane perpendicular to a back edge 26, and a lower edge 28 drawn along an angular slope between said back edge 26 and said upper edge 24 forming a triangular shape. The upper edge 24 includes detent 31 in a similar manner as side wall 14 having upper edge 30 with detent 32. The detents 26 and 32 operate as a hook for placement of various sporting items whether it be a jacket hook, hockey stick, or a bicycle. When used to support a bicycle, the detents support the frame of the bicycle. Of interest is that the spacing allows an individual to service the bicycle. In this manner, the wall mount spacing allows for free wheeling of bicycle wheels, the spacing of the side walls provides balancing support.

Figure 2:
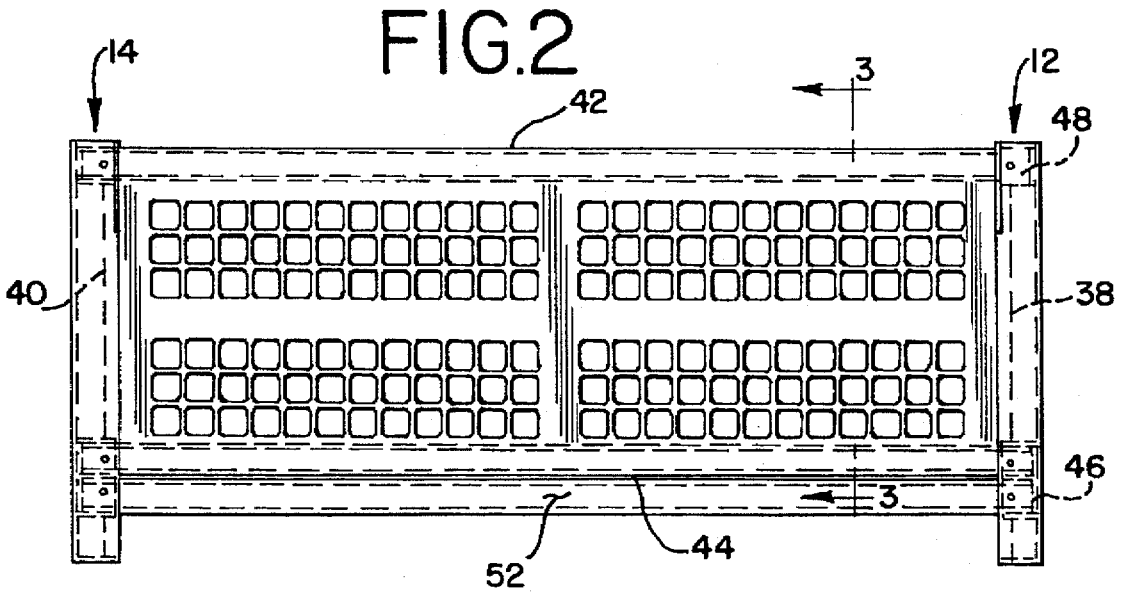
FIG. 2 is a top view of FIG. 1.
Figure 3:
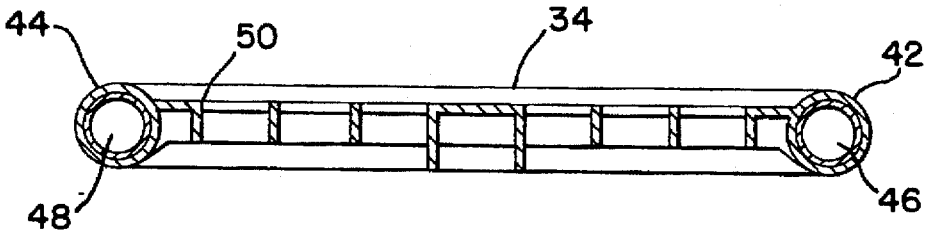
FIG. 3 is a cross sectional side view of FIG. 2 taken along lines 3—3.

A shelf 34 is secured between the side walls 12 and 14 consisting of a single molded piece of plastic having a plurality of apertures 36 placed therethrough providing an aesthetically pleasing design yet maintaining rigidity and shelf aeration. The shelf 34 is defined by shelf ends 38 and 40, shown by hidden lines concealed within the side walls 12 and 14, and shelf sides 42 and 44. The shelf sides 42 and 44 incorporate a steel tube 46 and 48, as shown in FIGS. 2 and 3, which are integrated into the shelf structure during the molding process of the shelf. The steel tubes 46 and 48 are encapsulated by the plastic resulting in an integral shelf having the properties of plastic, yet the reinforcement strength of steel. As shown in FIG. 3, the upper surface 50 of the shelf 34 is slightly depressed from shelf sides 42 and 44, encompassing the steel tubes, the shelf sides providing a raised ridge to prevent items placed on the shelf from rolling off the shelf surface.

In furtherance of the aforementioned example, the shelf, when used in combination with the side walls, provides not only a storage rack for a bicycle but also provides storage space for bicycle related goods such as water bottles, helmets, biking shoes, spare parts, and so forth. In this manner, the apparatus in this embodiment can be used by a bicycling enthusiast for storage and service of a bicycle, as well as support of all miscellaneous bicycling paraphernalia.

The inclusion of rod member 52 allows for items to hang from the storage apparatus. The rod member provides rigidity to the structure and consists of a steel tube placed within a polyethylene sleeve during a manufacturing process. The steel tube is preferably a one inch diameter core with the plastic sleeve approximately 1/16 of an inch.

Figure 4:
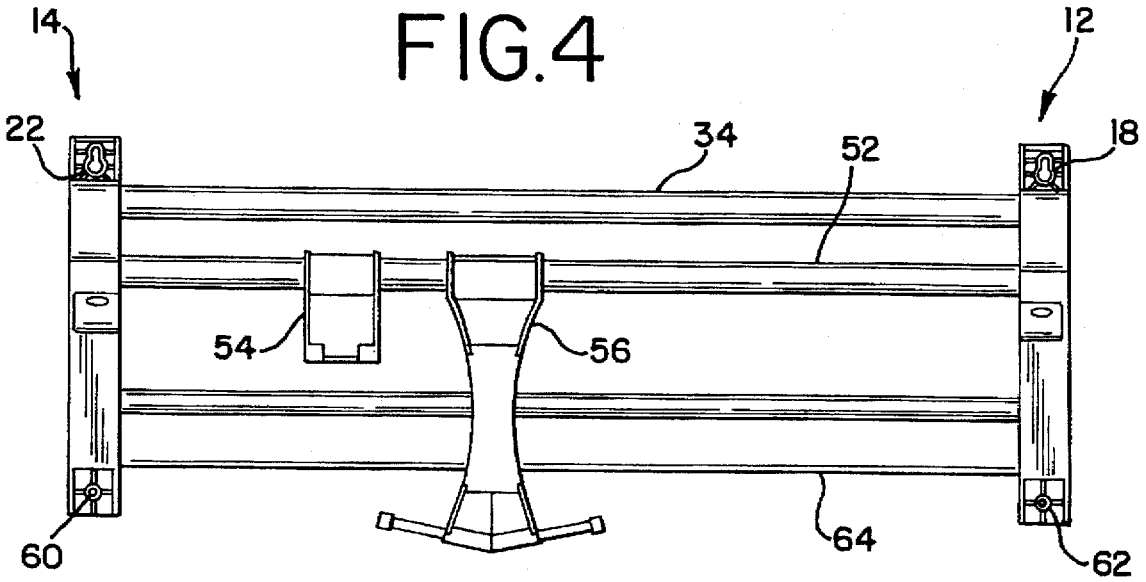
FIG. 4 is a front plane view of FIG. 1 including a bat hook and skate hook.

Now referring to FIG. 4, shown is a front view of the storage apparatus with side wall members 12 and 14. The rod member 52 provides a rigid member capable of supporting hanging items such as a coat hanger for clothing, or specially designed hangers claimed in co-pending applications for holding of baseball bats by use of a baseball bat holder 54, and in-line skates with skate hook 56. Through holes 60 and 62 provide support for side wall attachment along the bottom portion of each side wall. Tray 64 is disposed along a lower portion of the apparatus and supported by each side wall for holding miscellaneous items. The tray 64 is formed from a single piece of plastic having a U-shaped configuration insertable into a slot located along an inner side surface of each said side wall, as more fully described later in this specification.

Figure 5:
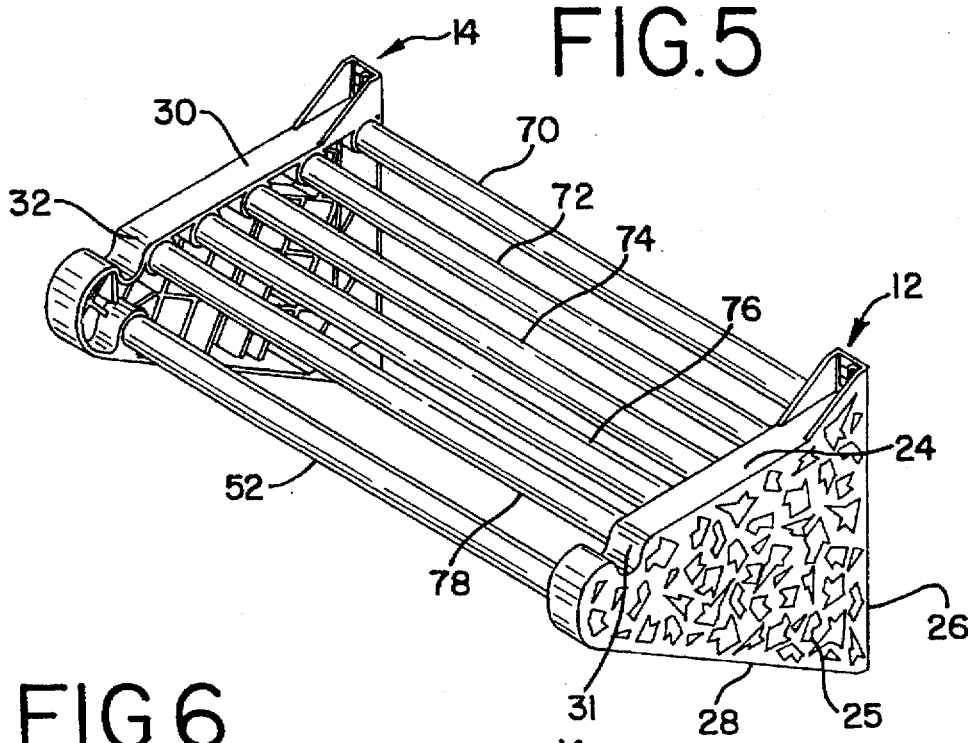
FIG. 5 is a perspective view of the storage shelf with a rod member support shelf.

Now referring to FIG. 5, set forth is a perspective view of an alternative embodiment of the instant invention wherein the flat shelf may be exchanged for a multitude of rod members depicted by numeral 70, 72, 74, 76, and 78. In this manner, the rod members may be added numerically to provide any type of support allowing for the spaced apart configuration providing support for large ball shaped items or, as shown, various sized items when the rod members are placed adjacent to each other. The inclusion of rod member 52 again allows for items to hang from the storage apparatus. Each rod member is interchangeable consisting of a steel tube placed within a polyethylene sleeve during a manufacturing process. The steel tube is preferably a one inch diameter core with the plastic sleeve approximately 1/16 of an inch.

Figure 6:
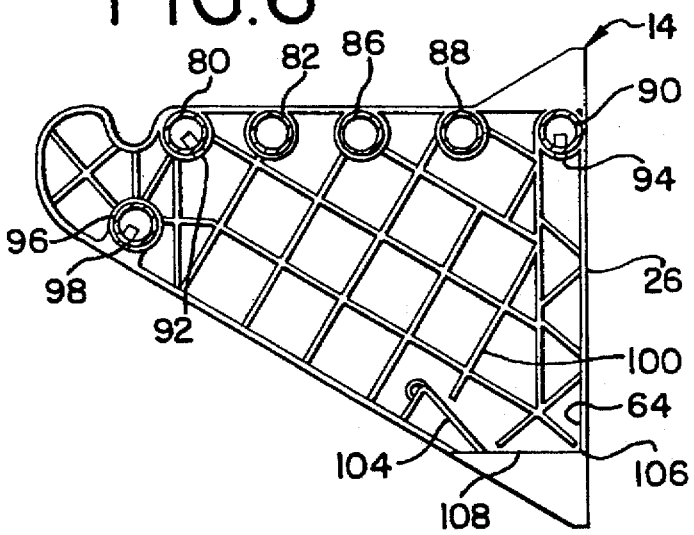
FIG. 6 is a front view of the inner surface of a side wall.

Referring to FIG. 5, the inner surface of side wall member 12 has an upper edge 24, a rear edge 26, and a lower edge 28. Beneath the upper edges of the sidewalls (sidewall members) are tubular supports 80, 82, 84, 86, 88 and 90 (FIG. 6). The tubular supports are formed integral with the side wall providing an aperture opening for placement of rod members preventing movement thereof. Rod supports 80 and 90 include a through hole located along one side of the rod support for insertion of fasteners 92 and 94 respectively. The fasteners are preferably plastic barbed insertion screws that resist removal by use of outwardly extending ribs that deflect in a single direction. The fasteners are inserted through the through hole and through a corresponding through hole placed along the end of the rod member thereby maintaining the rod member in the rod support. Rod support 96 is shown placed along lower edge 28 wherein a rod member placed within the rod support operates as the previously described hanging rod. Rod support 96 includes a through hole for placement of a fastener 98 also inserted through a corresponding through hole on the end of a rod member to prevent dislodgement of the rod member from the rod support.

Figure 7:
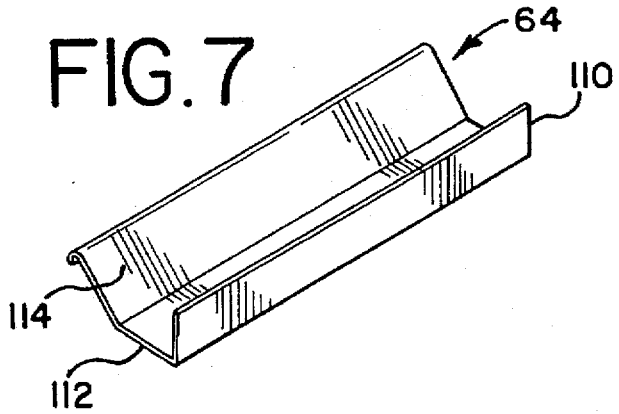
FIG. 7 is a perspective view of the tray.

The side wall includes a lattice reinforcement 100 providing reinforcement of the side wall for carrying loads while maintaining structural integrity of the rod supports. A bottom portion 102 of the side wall includes a provision for mounting of tray 64. In this manner, the tray 64 rests against tray ramp 104 along one side surface, the inner surface of rear wall 106 at a second side surface, and against support surface 108 therebetween. The lattice provides for frictional engagement thereby maintaining the tray in a fixed and secure position. The tray 64 has an upright back wall 110, a lower planar wall 112, and a curved frontal wall 114. As illustrated in FIG. 7, the shape of the tray allows for insertion into a side wall member wherein each end 116 and 118 fit into the predefined slot for proper support.

As an example of use, two rod members positioned in rod supports 80 and 90 provides an upper shelf for storage of similar size ball items such as basketballs and soccer balls. A third rod member position in rod support 96 provides the aforementioned hanging rod. Yet another tubular support member can be added to the frame allowing the shelf to accommodate both large items, as well as small ball shaped items such as baseballs, tennis balls, and so forth. In addition, still a fifth rod support member can be placed providing a planar shelf wherein the spaced apart rod members are capable of supporting a variety of goods as desired by the consumer. Alternatively, the plastic shelf 34 may be utilized with the integrated steel tubes positioned within rod supports 80 and 90 providing a large planar surface.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An apparatus comprising:

a pair of symmetrical sidewalls for positioning against an upright wall, each of said sidewalls comprising a support member having a back edge available for securement to said upright wall, an upper edge and a lower edge, said support member having an inner side surface and an outer side surface; and a rod member extending between and connected to said sidewalls, said rod member comprising a metal tube and a plastic sleeve annularly surrounding and extending substantially along said metal tube, and said metal tube being positioned within said plastic sleeve; and wherein said upper edge of each support member includes a detent sized to accommodate a support bar of a conventional bicycle, said detent being positioned between said back edge and said rod member.

2. The apparatus according to claim 1 wherein said metal tube comprises a steel tube and said sleeve comprises a polyethylene sleeve.

3. The apparatus according to claim 1 wherein said support members comprise plastic support members with a lattice reinforcement and supports for receiving and supporting said rod member.

4. The apparatus according to claim 1 wherein:

said outer said surface of each support member includes graphic indicia: and said apparatus includes a tray between said support members at a level below said rod member, said tray comprising an upright back wall, an inclined frontal wall and a substantial planar wall extending between and connecting said upright back wall and said inclined frontal wall.

5. The apparatus according to claim 1 including a skate-hook positioned on said rod member for carrying in-line skates.

6. The apparatus according to claim 1 including a baseball bat holder positioned on said rod member.

7. The apparatus according to claim 1 including a shelf positioned at a level above said rod member, said shelf comprising plastic and metal tubes disposed within said plastic, and said metal tubes extending between and connected to said sidewalls at a level above said rod member.

8. A multi-purpose storage shelf, comprising:

a pair of plastic sidewalls having a back edge available for securement to an upright wall, an upper edge, a lower edge, an inner side surface and an outer side surface;

a rod member extending between and connected to said sidewalls, said rod member comprising a metal tube and a plastic sleeve annularly surrounding and extending substantially along said metal tube, and said metal tube being positioned within said plastic sleeve a plastic shelf positioned at a level above said rod member and extending between and connecting said sidewalls, said shelf having a depressed plastic upper surface for supporting a ball and having plastic sides providing raised ridges for preventing the ball from rolling off the upper surface of the shelf, said sides including metal tubes, said metal tubes being positioned and integrated into said plastic sides and extending along the longitudinal length of said plastic shelf, said metal tubes in said plastic shelf extending between and connected to said sidewalls at a level above said rod member.

9. The multi-purpose storage shelf according to claim 8 wherein said sidewalls define detents sized to accommodate a support bar of a conventional bicycle, said detent being positioned between said rod member and said plastic shelf.

10. The multi-purpose storage shelf according to claim 8 wherein said plastic shelf defines an array of apertures for aeration and provides a sports shelf for supporting a water bottle, helmet, biking shoes, bicycle parts, ball, or other sports equipment.

11. The multi-purpose storage shelf according to claim 10 wherein said plastic is polyethylene and said metal is steel.

12. A multi-purpose support shelf, comprising:

a pair of sidewalls having a back edge available for securement to an upright wall, an upper edge, a lower edge, an inner side surface and an outer side surface, said inner side surface having a plurality of rod supports a rod member extending between and connected to said sidewalls, said rod member comprising a metal tube and a plastic sleeve annularly surrounding and extending substantially along said metal tube, and said metal tube being positioned within said plastic sleeve;

a rod member support shelf extending between and connected to said sidewalls at a level above said rod member, said shelf comprising a set of metal tubes extending between and connected to said rod supports, each of said metal tubes having an outer surface positioned within and encapsulated in a plastic sleeve; and wherein said upper edge of each of said sidewalls includes a detent sized to accommodate a support bar of a conventional bicycle, said detent being positioned between said rod member and said rod member support shelf.

13. The multi-purpose support shelf according to claim 1 including barbed plastic insertion screws for securing said metal tubes of said rod member support shelf to said rod supports and said rod member support shelf comprises 2 to 5 metal tubes encapsulated in plastic sleeves for supporting a plurality of balls selected from the group consisting of a basketball, soccer ball, baseball, tennis ball, and combinations thereof.

* * * * *